United States Patent [19]

Farmer

[11] 3,973,415

[45] Aug. 10, 1976

[54] PATTERN MECHANISM

[75] Inventor: Ernest Leonard Farmer, Leicester, England

[73] Assignee: Wildt Mellor Bromley Limited, England

[22] Filed: Dec. 10, 1974

[21] Appl. No.: 531,384

[30] Foreign Application Priority Data

Dec. 22, 1973 United Kingdom ..... 59705/73

[52] U.S. Cl. ..... 66/50 B; 66/25; 66/50 R

[51] Int. Cl.[2] ..... D04B 15/74

[58] Field of Search ..... 66/50 B, 40, 25, 36, 66/50 R, 156

[56] References Cited

UNITED STATES PATENTS

| | | | |
|---|---|---|---|
| 1,678,906 | 7/1928 | Howie | 66/50 R |
| 3,004,413 | 10/1961 | Felker | 66/50 B |
| 3,006,174 | 10/1961 | Haddad | 66/156 |
| 3,609,995 | 10/1971 | Harris et al. | 66/50 B |
| 3,748,871 | 7/1973 | Ludwig et al. | 66/50 B |
| 3,759,069 | 9/1973 | Scheffler et al. | 66/50 B |
| 3,846,996 | 11/1974 | Comas | 66/50 B |
| 3,864,941 | 2/1975 | Kuhn | 66/50 B |

FOREIGN PATENTS OR APPLICATIONS

| | | | |
|---|---|---|---|
| 424,883 | 2/1926 | Germany | 66/156 |
| 1,203,406 | 8/1970 | United Kingdom | 66/50 B |

*Primary Examiner*—Mervin Stein
*Assistant Examiner*—A. M. Falik
*Attorney, Agent, or Firm*—Robert E. Burns; Emmanuel J. Lobato; Bruce L. Adams

[57] ABSTRACT

In a circular knitting machine, needle selection is controlled by pattern keys mounted on a pivoted pattern key carrier and having patterning butts which are selectively engageable with vertically stacked selector slides. The selector slides are engageable selectively with selector butts on pressers associated with needle jacks. When a presser is engaged by a selector slide the corresponding jack is pressed in so that a control butt on the jack is not engaged by a needle-operating cam. Pivoting of the pattern key carrier is controlled by a boat-shaped cam follower which is carried on an arm on the pattern key carrier and travels in one or another of circular tracks concentric with the needle cylinder. Means is provided for switching the cam followers from one track to another, thereby pivoting the pattern key carrier to bring other pattern keys into engagement with selector slides.

9 Claims, 11 Drawing Figures

PATTERN MECHANISM

The invention relates to circular knitting machines and especially their patterning mechanisms. The patterning mechanisms may be used on multi-feed circular knitting machines including those for producing double jersey fabric.

According to the invention there is provided a circular knitting machine which includes:

A. a cylinder for fitting with needles and a cam plate with a knitting station for acting on the needles, the cylinder and cam plate being rotatable one with respect to the other around the central axis of the cylinder;

B. a pattern key mounting fixed with respect to the cam plate for fitting with at least two pattern keys and rotatable around an axis located outside the cylinder to control needle selection at the knitting station by any one of the pattern keys, the pattern key mounting having a member for controlling its angular rotational position with respect to the cam plate;

C. at least two tracks in fixed relationship to the cylinder for guiding the control member, said tracks comprising circular portions for holding the pattern keys in a particular angular position; and D. a means between circular portions of the track for moving the control member from one track to another and for rotating the pattern key mounting to bring another pattern key into a position controlling needle selection.

The circular machine may have a rotatable cylinder and fixed cam box or a fixed cylinder and rotatable cam box.

The pattern key mounting may be part of a patterning mechanism which further includes a set of slides for acting on pressers associated with jacks and needles on the needle cylinder to control the selection of needles and so the pattern of the fabric knitted. The selection of the needles may be to cause them to non-knit, tuck or knit. The pattern key mounting may be rotatable over a limited angle and be pivoted to and fro as required to bring the appropriate pattern key into action. The pattern key mounting may also be capable of rotating for a complete turn. The control member may be a lever joined to the mounting. It may also act on the mounting through intermediate components.

Preferably the pattern key mounting is adapted to receive the pattern keys by providing slots in the mounting and a number of pins protruding into the slots for suspending the pattern keys. Advantageously the mountings are adapted to accommodate only two pattern keys. The pattern keys may have recesses shaped so that the pattern keys can slide over the pins and then be lowered to prevent withdrawal. Preferably the recesses are L-shaped.

The number of tracks generally corresponds to the number of alternatively operable pattern keys. The tracks may be formed in a drive gear of the cylinder or in the cylinder. The tracks may be grooves. The tracks may guide the control member by engaging a cam-follower on the member. The cam follower preferably has a double convex, boat-like shape. The member may be a crank attached to a shaft on which the pattern key mounting is pivotted.

The means between circular portions of the track for moving the control member may be a switch-over section of the track formed in, say, the drive gear of the cylinder. Preferably the switch-over section is formed by a number of removable cam-portions to facilitate manufacture and to enable the switch-over sequence to be altered. Suitably the switch-over section comprises a slide movable into a number of positions to enable the switch-over operation to be timed. The switch-over section may be formed to provide an endless path including all the annular tracks so that the control member moves automatically and in a predetermined sequence from one track to the next. The switch-over section may also be formed to provide a number of alternative endless tracks and include a means for switching from one track to the next as and when required.

Preferably the patterning mechanism has an integral housing for the slides and the pattern key mounting. The pattern key mounting may have pivot portions with flats received in the housing and slots may be provided in the housing to enable the pattern key mounting to be withdrawn. Conveniently then the shaft for reciprocating the mounting may comprise two portions releasably keyed together to enable the mounting to be turned independently of the cam follower.

A circular knitting machine may be provided with a patterning mechanism of the invention at each knitting station. The knitting stations may be closely spaced as the patterning mechanism of the invention may be compact. The track formed in the knitting machine to pivot the cam follower in synchronism with the knitting process is preferably one comprising at least two concentric portions interconnected by a cross-over section.

The invention is more particularly described with reference to the accompanying drawings in which.

Construction of the patterning mechanism of FIGS. 1 to 4

Figure 1:
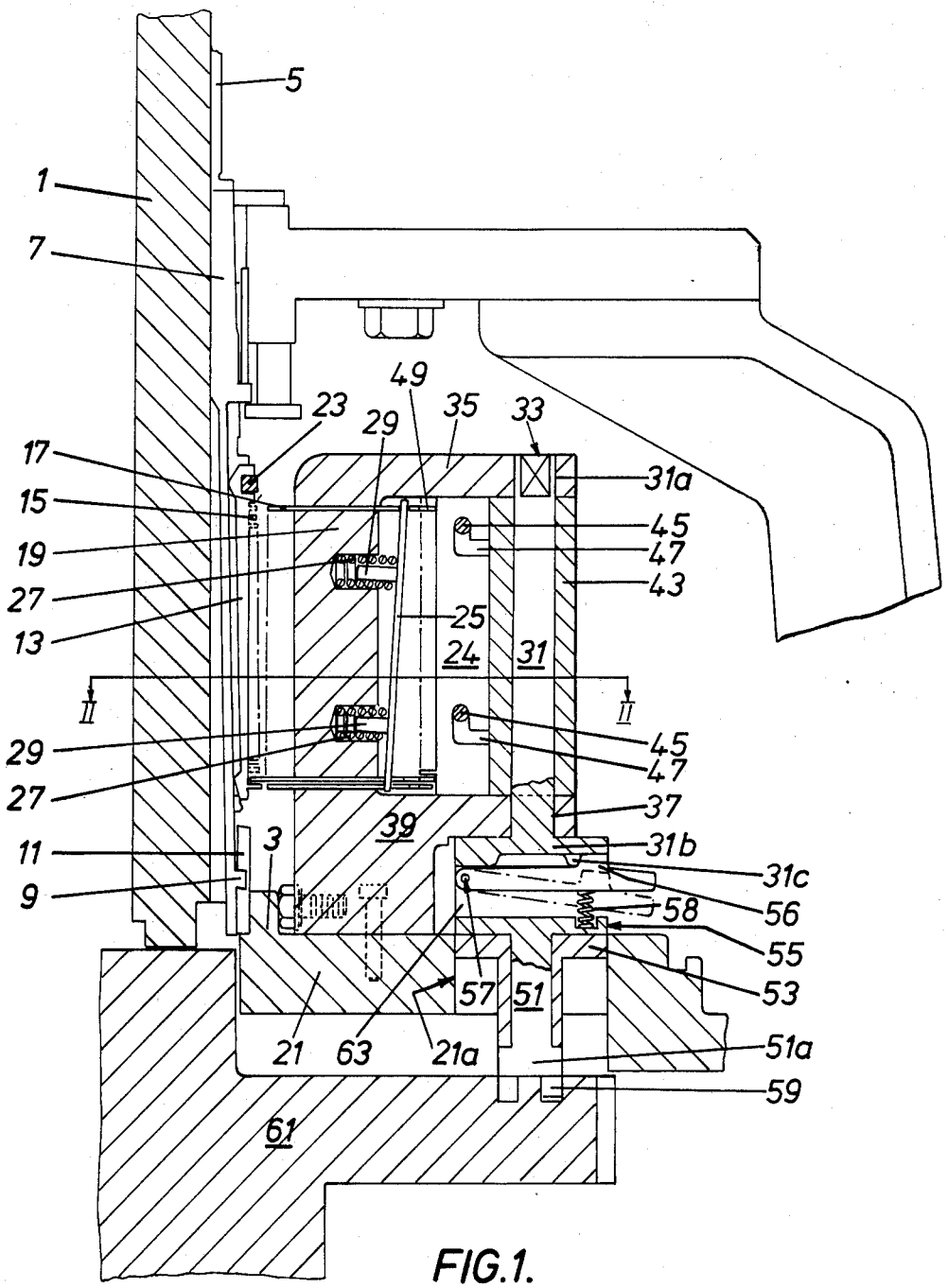
FIG. 1 is a section on line I—I in FIG. 2 of a patterning mechanism according to the invention mounted on a knitting machine.

With reference to FIG. 1, a knitting machine of the single cylinder and dial type has a rotatable needle cylinder 1 mounted on an annular drive gear 61 for conjoint rotation. The needle cylinder 1 has tricks in which needles 5 and spring tailed jacks 7 are mounted for axial sliding movement whilst the needle cylinder 1 rotates around the centre axis of the cylinder. Associated with the jacks in each trick are jack pressers 13, which are rotatable jointly with the jacks 7 and are suspended at a constant level by a fixed rail 23.

The jack 7 is provided with a control butt 9 near its lower end, which butt is directed outward from the cylinder 1. The presser 13 lies against the jack 7 at a position adjacent the rail 23. The jack 7 has a portion near the top positively located in the trick and a tail portion extending to the control butt 9 which is sprung and can be urged toward the cylinder 1. The presser 13 is adapted for bearing on one side against the tail portion at position below the rail 23 to urge the jack 7 toward the cylinder 1. On the other side of the presser is placed a pattern butt 15. The pattern butts 15 for differing pressers 13 are placed at different heights with respect to the rail 23.

The knitting machine also comprises a stationary annular camplate 21 positioned above the drive gear 61. The camplate 21 is formed near the cylinder 1 with an annular extending ridge serving as a cam carrier 3. The knitting machine has numerous knitting stations spaced around the circumference of the needle cylinder 1. From 60 to 72 knitting stations could for example be present. In advance of each knitting station is positioned a patterning mechanism mounted on the cam plate 21. Each such mechanism comprises a jack raising cam 11 attached to the cam carrier 3 and adapted to act on the jack control butts 9, a set of selector slides 17 and their mounting, a pair of pattern keys 24 and support therefor and a control for the pattern keys 24.

The selector slides 17 are stacked vertically at levels corresponding to the levels of the pattern butts 15 on different pressers 13 (see FIG. 1). The slides 17 have a convex front edge facing the needle cylinder and rear edge facing away from the needle cylinder. The slides 17 are formed between the front and rear edge with a recess (see FIG. 2). The slides 17 are held in the stacked positions in a bracket 19 in between the front and rear edge so as to allow a limited sliding movement away from or toward the cylinder 1. The bracket 19 is bolted on the top of the cam plate 21. The bracket 19 has a pair of recesses in which a pair of compression springs 27 are mounted. A pair of studs 29 secured to a plate 25 are centrally received in the springs 27. The plate 25 engages the slides 17 from a position inside the recess in the slides 17 and urges the slides 17 away from the cylinder 1.

The pattern keys 24 are supported by a pattern key carrier or mounting 43 mounted by a vertical shaft 31 in extensions of the bracket 19. The vertical shaft 31 is rotatable about an axis outside the periphery of the needle cylinders. An upper end 31*a* of the shaft 31 is received at 33 in an upper extension 35 of the bracket 19. A lower end of the shaft 31 is contained at 37 in a lower extension 39 of the bracket 19. The carrier 43 has radially extending, angularly displaced vertical slots and pairs of pins 45 extending across the slots of two vertically spaced positions. The pattern keys 24 are in the form of plates having appropriately positioned selection butts 49 at the front edge and a pair of L-shaped recesses 47 adjacent the rear edge. The pattern keys 24 are retained in the slots in the carrier 43 by the pins 45 being received in upright sections of the L-shaped recesses 47 and by the extensions 35 and 39 bearing against the upper and lower edges of the keys 24. The butts 49 on the pattern keys 24 are then accurately held at levels corresponding to the different levels of the superposed slides 17. The shaft 31 is provided with milled flats 31*d* (see FIG. 2) at 33 and 37. Slots 39*a* are formed in the extensions 35 and 39 leading to apertures in which the shaft 31 is received.

The angular position of the pattern keys 24 is controllable by the following arrangement. The shaft 31 has an annular out turned flange 31*b* positioned below the extension 39 of the bracket 19, which flange 31*b* has a radial slot 31*c*. A further shaft 51 is mounted in the cam plate 21 in a bearing 53 secured by screws 54 (see FIG. 3). The shaft 51 is provided with a cylindrical head 55 above the cam plate 21. The head 55 has a diametrical slot 63 in which is mounted a catch 56 pivoted on a pin 57 and sprung upwards by a spring 58. The slot 63 and slot 31*c* are aligned. The catch 56 is received in the slot 31*c* and keys the shafts 31 and 51 together. Below the cam plate 21, the shaft 51 has a crank-like end or lever 51*a* which extends between the cam plate 21 and the drive gear 61. A boat shaped cam follower 59 is pivotably mounted underneath the end 51*a*. The drive gear 61 has parallel tracks 60, 60*a* for receiving the cam follower 59. The tracks 60, 60*a* comprise two generally circular concentric sections and an X-shaped switch-over section 62 to allow the cam follower to cross-over from the outer circular section to the inner or vice versa. The tracks 60, 60*a* thus hold the shaft 51 in either of two angular positions.

Setting Up

The catch 56 is first depressed to enable the pattern key carrier 43 to be pivoted until the flats 31*d* at 33 and 37 are aligned with the slots 39*a* in the extensions 35 and 39. The carrier 43 can then be drawn out of the bracket 19 with the shaft 31 passing through the slots 39*a*. Next, the previously used pattern keys 24 can be removed by lifting them and then withdrawing them out of the slot in the carrier 43. New pattern keys can be prepared by removing appropriate selection butts from a pattern key having a set of butts suitable for acting on each of the slides 17. These new pattern keys can then be hooked on the pins 45 whilst inserting them in the slot 47. The carrier 43 can then be introduced and placed in position on the extensions 35 and 39 and be turned until the catch 56 re-enters the slot 31*c*.

Operation

Figure 2:
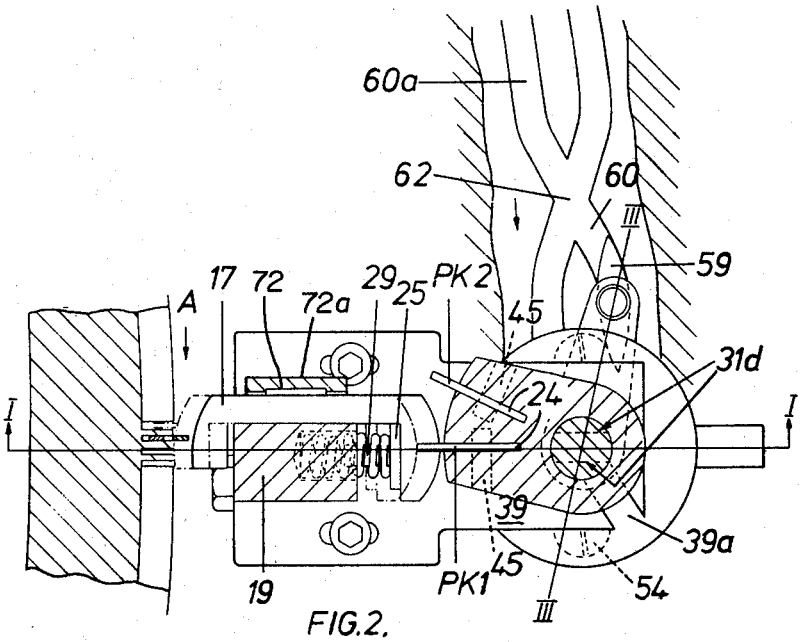
FIG. 2 is a section on line II—II of FIG. 1.
Figure 5:
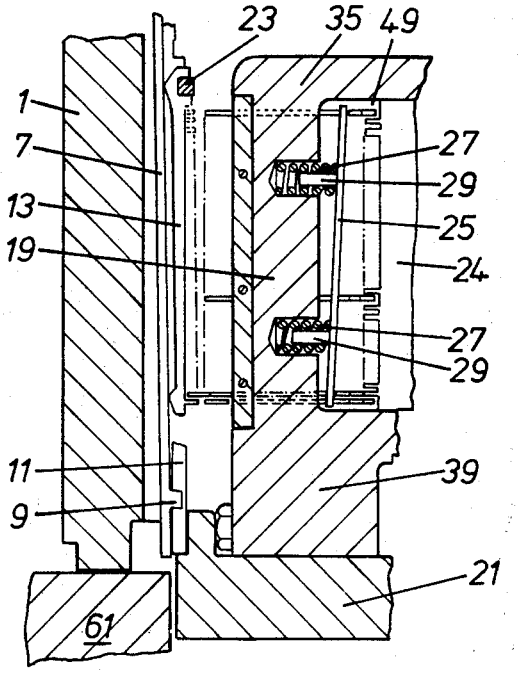
FIG. 5 is a section through lines V—V of FIG. 6 of part of a modified patterning mechanism according to the invention.
Figure 3:
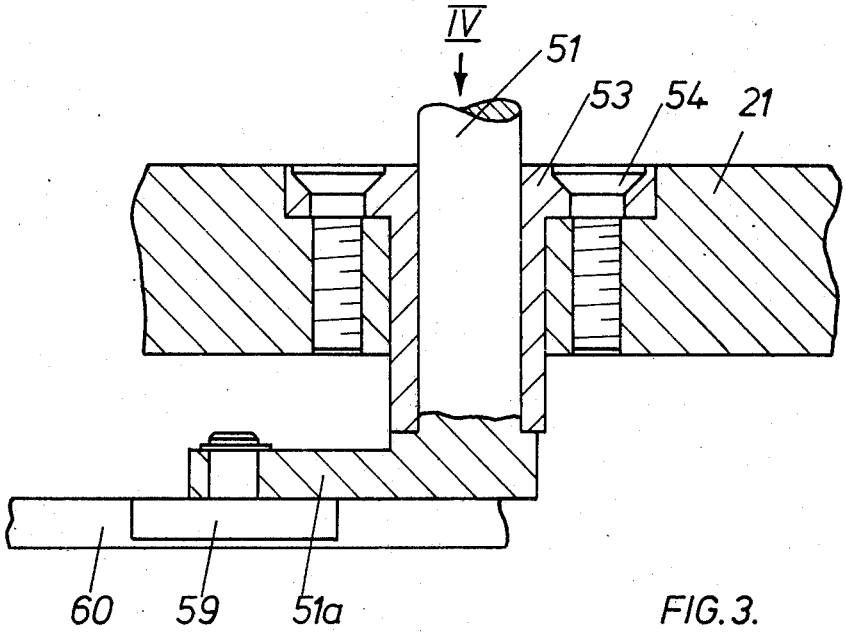
FIG. 3 is a section of part of the mechanism on line III—III in FIG. 2.

In operation, if starting from the position shown in FIG. 2, and if rotating the cylinder 1 in the direction of arrow A in FIG. 2, the boat-shaped cam follower 59 will turn slightly and be guided from the outer track section 60 to the inner track section 60*a*. When the boat-shaped cam follower 59 crosses over, the crank shaped end 51*a* is pivotted to the left in FIG. 2 and the pattern key 24 marked PK 2 moves into the position which in FIG. 2 is occupied by the pattern key 24 marked PK1. The pattern key PK2 will move certain slides 17 towards the needle cylinder 1 against the pressure exerted by the springs 27 through the plate 25. When pressers 13 having a pattern butt 15 at a level corresponding to that of those slides 17 move past the slides 17, the pressers will be pushed toward the cylinder 1 and prevent the butt 19 of the spring tailed jack 7 engaging the jack raising cam 11. The needles 5 associated with such jacks 7 will thus remain in an inactive position. All other needles 5 will be raised to an active position by their jacks 7. The pattern key PK1 is inactive in this position of the crank-shaped end 5*a*.

At the completion of a single revolution of the cylinder, the cam-follower will cross-over back into the outer track section 60 pivoting the crank-shaped end 51*a* to the right in FIG. 2. The pattern key PK1 is thus activated and moves against the slides 17 after the pattern key PK2 has been deactivated and pivoted away from the slides 17. During the next revolution the pattern key PK1 will control which needles are kept down in an inactive non-knit position. The cam follower is boat-shaped to facilitate a smooth cross-over from the track 60 to the track 60a or vice versa.

Figure 4:
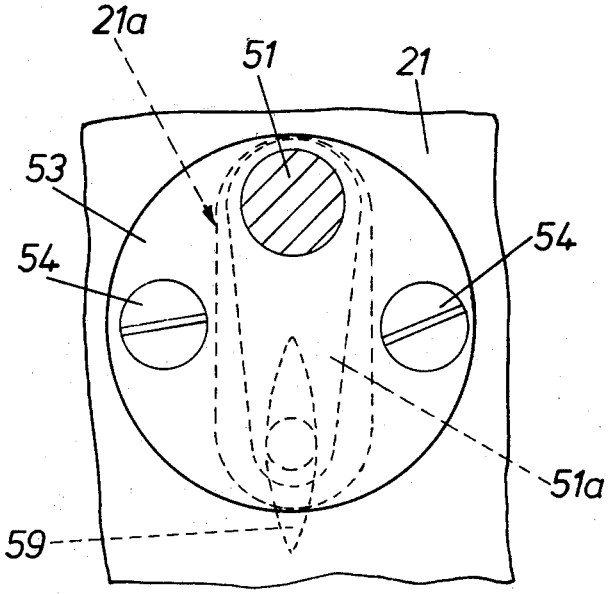
FIG. 4 is a plan view of the parts shown in FIG. 3.

As shown in FIGS. 1 and 4, an elongated slot 21a is formed in the cam plate 21. A bearing bush 53 secured with screws 54 locates the shaft 51 midway in the slot 21a. The shaft 51 can be withdrawn together with the crank-shaped end portion 51a and the cam follower 59 by releasing the screws 54 and drawing the shaft 51 and bush 53 outward (see FIG. 4) and then lifting the assembly. Thus access to the cam track 60, 60a can be gained without having to remove the cam plate 21.

In other constructions more than two tracks could be used to bring successively more than 2 pattern keys into the active position.

In consequence of the switching of the follower 59 between the tracks in successive revolutions the shaft 31 is reciprocated to place either the pattern key PK1 in action as shown in FIG. 2 or the key PK2. At the cross-over point 62 there is a transition and for the duration of the cross-over neither pattern key controls the slides 17. If no special action is taken the slides 17 may dangerously interfere with the patterning butts 15. Thus it may be necessary to remove the jacks 7 and their associated needles 5 from that transition zone of the needle cylinder which is adjacent the switch-over part 62 of the track. Alternatively some measure can be taken such as that described in the British Patent Specification No. 902/73 to ensure that the pattern butts of the presser 13 are grouped appropriately to co-operate with staggered banks of selector slides in order to 'bridge' the cross-over position of the cam tracks and to provide positive control of the needles during a whole cylinder revolution.

With a patterning mechanism of the invention, the patterning facility is increased and a bigger repeating pattern area can be utilised. The mechanism is further simple and compact in construction and changes in the pattern keys can be made in a simple fashion.

Construction of the patterning mechanism of FIGS. 5 to 11

With reference to FIGS. 5 to 11, the patterning mechanism is generally the same as the mechanism described with reference to FIGS. 1 to 4. Corresponding parts have been indicated with the same numerals. The mechanisms differ in the following respects.

a. Control of the slides 17

A magnetic bar 70 is mounted (see especially FIG. 6) on the front of the bracket 19. This bar 70 holds nonselected slides 17 and prevents them from being accidentally moved forward. The bar 70 acts in conjunction with friction pads 72 mounted in brackets 72a and bearing on the sides of the slides 17.

b. Construction of switch-over part 62

Figure 6:
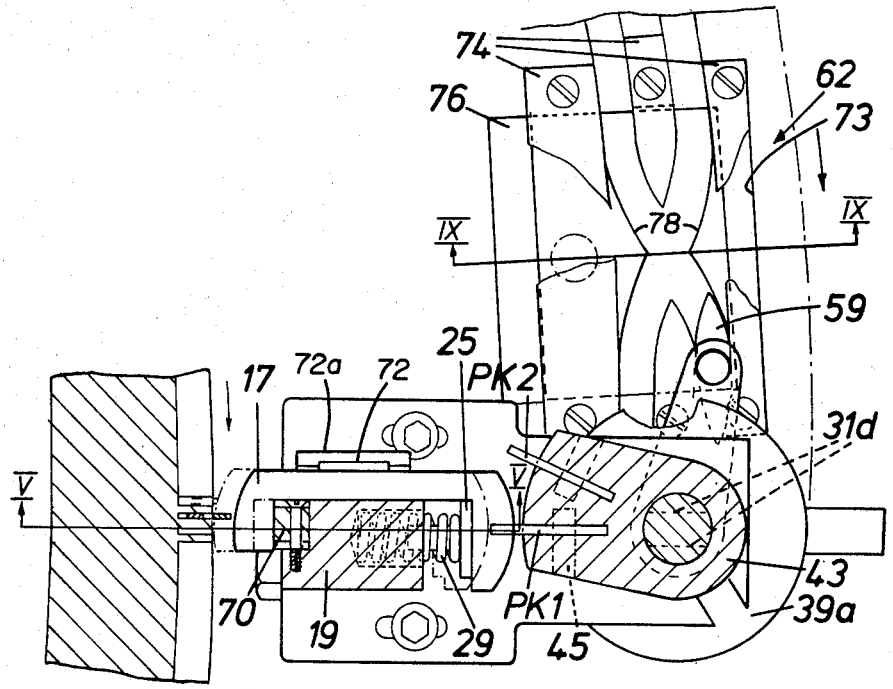
FIGS. 6, 7 and 8 are top elevations of the modified mechanism of FIG. 5 in different stages of operation.
Figure 7:
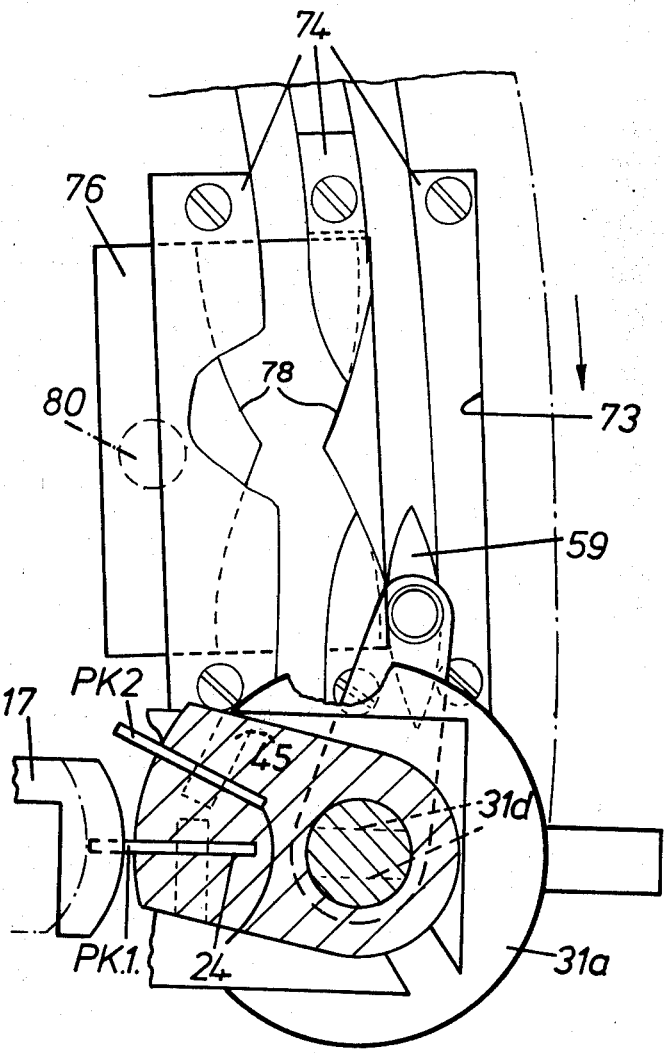
Figure 8:
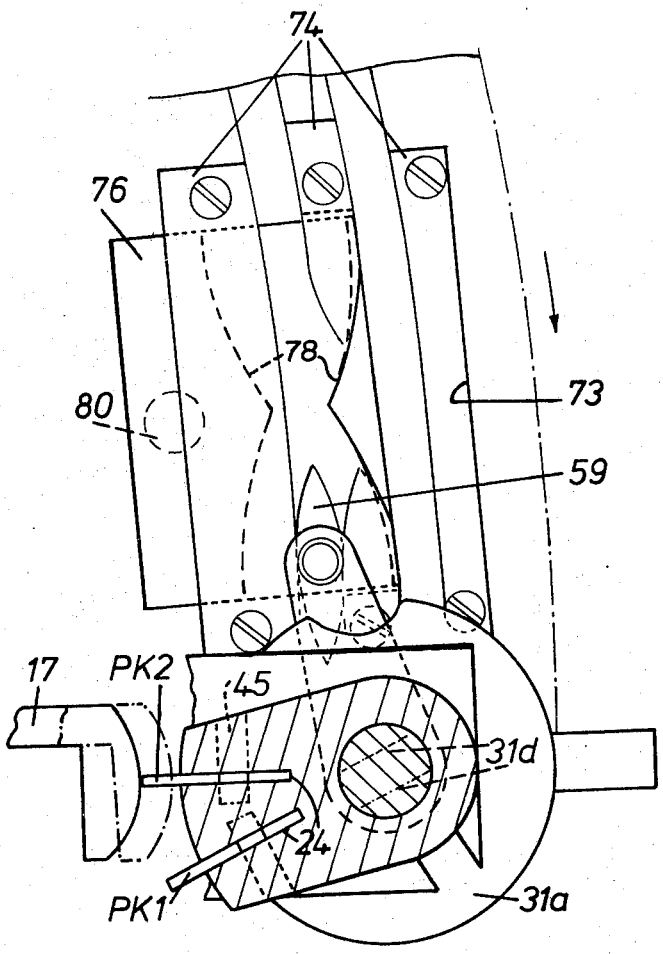

A recess 73 may be formed (see FIGS. 6 to 9) at the location of the switch-over part. The cross-over of the tracks can be formed in part or wholly by cam pieces 74 bolted into the recess 73. In this case a radially slidable member 76 is provided in the recess 73. The member 76 has cam surfaces 78 which may cooperate with cam surfaces of cam pieces 74 bolted into the recess 73. The cam surfaces 78 lie underneath and between the cam surfaces of the cam pieces 74 in such a way that the slidable cams move into inner and outer positions shown in FIG. 6, and in FIGS. 7 and 8 respectively. In FIG. 6 the cam surfaces combine to provide a cross-over configuration for moving the cam follower 59 from the inner to the outer track and vice versa. In FIGS. 7 and 8, the cam surfaces combine to provide a separate inner and outer track. FIG. 7 shows a cam follower 59 continuing past the switch-over part 62 in the outer track and FIG. 8 shows a cam follower 59 continuing in the inner track.

Figure 9:
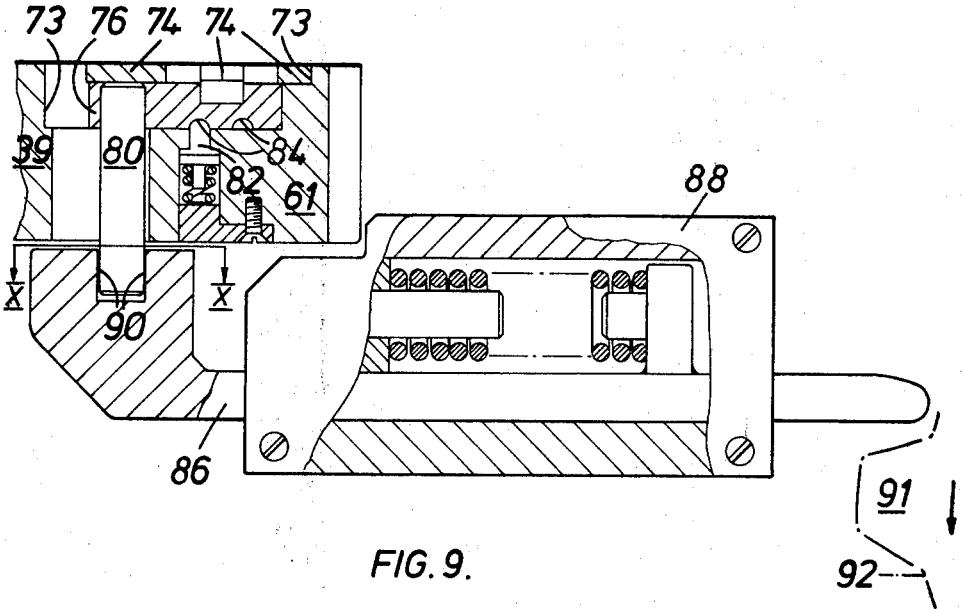
FIG. 9 is a section through line IX—IX of FIG. 6.
Figure 10:
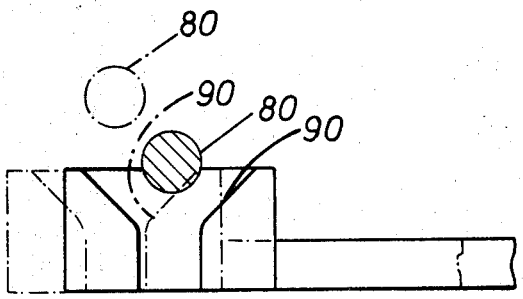
FIG. 10 is a section through line X—X of FIG. 9.

FIGS. 9 and 10 illustrate one possible arrangement for sliding the member 76. A pin 80 is secured to the member 76 and sticks out through a recess in the cylinder gear 61. A resilient, rounded pin 82 mounted in the gear 61 is adapted to register with a hole 84 under the member 76 to locate the member 76 in its inner or outer position. The pin 80 is actuated by a circumferentially fixed, radially movable element 86 slidably held in a stationary housing 88. The front portion of the element 86 is formed with a funnel-like recess 90 whose inclined sides can move the member 76 to its inner or outer position, depending on whether the element 86 is projected or retracted. The rear portion of the element 86 is controlled generally indirectly by a cam portion 91 and a main pattern chain or drum 92 of the knitting machine.

The switch-over part 62 can thus be changed from one track configuration to another. In accordance with patterning requirements all cam followers 59 may engage in the inner track or the outer track.

Figure 11:
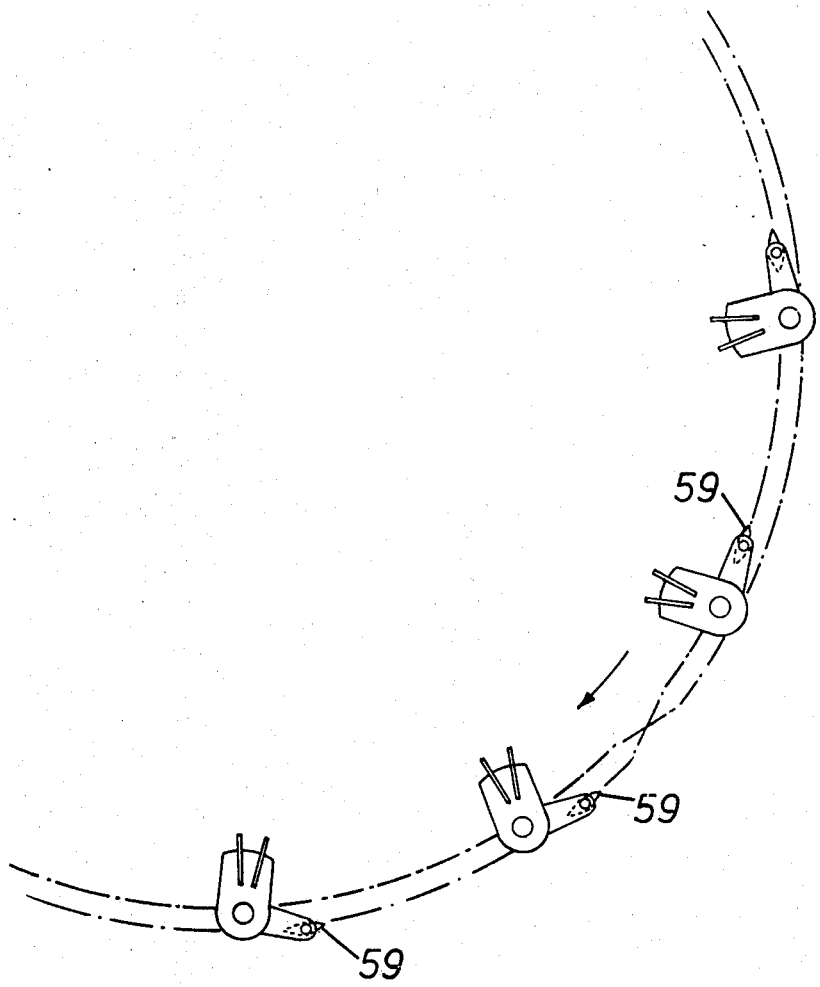
FIG. 11 is a schematic partial top elevation of a circular knitting machine having a patterning mechanism according to the invention.

FIG. 11 illustrates the arrangement of the pattern keys and their mounting around the needle cylinder periphery. The cam followers 59 are shown switching from the inner track to the outer.

Other, electrically, magnetically, hydraulically or pneumatic means may be used to move the slidable member 76. The switch-over should be effected in the interval between successive needle selection operations and this may restrict the spacing of knitting stations where cams are used. Generally the pattern key mounting can be placed closely together.

I claim:

1. A circular knitting machine which comprises a cylinder with needles and a cam plate with a knitting station for acting on the needles, a drive means for providing relative rotation between the cylinder and cam plate one with respect to the other around a central cylinder axis;

a pivotable pattern key mounting, a shaft for the mounting located with respect to the cam plate, at least two pattern keys fitted on the mounting, patterning butts on the keys defining at least two rows of butts spaced angularly around the shaft, a lever associated with the mounting and pivotably conjointly with the mounting, and a cam follower on the lever;

at least two parallel tracks for engaging the cam follower, the tracks comprising each a circular portion concentric with the cylinder axis, extending around the cylinder for a substantial arc thereof, and preventing pivotal movement of the lever and mounting to locate one row of butts in an operative position controlling needle selection for the knitting station, and means fixed angularly with respect to the cylinder for camming the cam follower from one track to another, said camming means being located between ends of the circular portions, and having cam faces inclined with respect to a radius from the cylinder axis to move the cam follower from one track to another and thereby pivot the lever and mounting to locate another row of butts in the operative position.

2. A circular knitting machine as claimed in claim 1, in which a plurality of knitting stations are provided angularly spaced around the cylinder, each knitting station being associated with a patterning mechanism to provide an arcuately extending array of patterning mechanisms, the circular portions of said tracks being spaced radially from one another and extending over an arc of the cylinder at least as great as that occupied by the array of patterning mechanisms, and said lever being a cranked lever fixed to the mounting shaft.

3. A circular knitting machine as claimed in claim 1, in which a set of slides is provided associated with the pattern key mounting for selecting needles.

4. A circular knitting machine as claimed in claim 1, in which upright slots are provided in the pattern key mountings for receiving the pattern keys and a plurality of pins extend transversely across the slots to engage in recesses in the pattern keys.

5. A circular knitting machine as claimed in claim 4, in which said recesses in said pattern keys for engaging with the pins are L-shaped.

6. A circular knitting machine as claimed in claim 1, in which the means for camming the cam follower from the circular portion of one track to the circular portion of another is a track portion having an X configuration joining the circular portions.

7. A circular knitting machine as claimed in claim 1, in which the camming means between circular portions of the tracks comprises a slide having a first guide path with inclined cam faces for moving the cam follower from one track to the other by the relative movement of the cylinder and cam plate and a second guide path comprising an unobstructed circumferentially extending portion for permitting the cam follower to remain in the same track, the slide being bodily movable radially to selectively place said guide paths in position for receiving the cam follower.

8. A circular knitting machine which includes a cylinder having tricks, needles and jacks in the tricks, butts for needle control arranged at varying heights on the jacks for selection of needles; a cam plate; a plurality of cams and yarn feeders defining knitting stations mounted on the cam plate, the cam plate and cylinder being relatively movable; a plurality of stacks of radially movable slides mounted on the cam plate and located in advance of the knitting stations to operate on selected butts; a plurality of pattern key mountings associated with each of the slide stacks; a shaft on the pattern key mounting pivotably received in the cam plate, a cranked lever, one end of the lever being joined to the shaft, the lever extending below the cam plate; a boat-shaped cam follower pivotably mounted on the other end of the cranked lever; at least two pattern keys releasably retained in the pattern key mounting for moving selected slides radially: an annular member connected with the cylinder and located below the cam plate; at least two, part circular, parallel tracks extending around the cylinder formed in the annular member locating the boat-shaped cam follower against radial movement; and switching means for moving the cam follower from one track to another to thereby pivot the pattern key mounting and bring another pattern key into a slide controlling position.

9. A circular knitting machine as claimed in claim 8, in which said switching means comprises a slide carrying cams defining a first guide path for guiding the cam follower from one track to another and a second guide path permitting the cam follower to continue in the same track, said slide being bodily movable to selectively place said guide paths in position for receiving the cam follower.

* * * * *